US007564188B2

(12) United States Patent
Kwon et al.

(10) Patent No.: US 7,564,188 B2
(45) Date of Patent: Jul. 21, 2009

(54) PLASMA DISPLAY PANEL COMPRISING A DIELECTRIC LAYER WITH A CONVEX PORTION

(75) Inventors: Jae-Ik Kwon, Suwon-si (KR); Kyoung-Doo Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 579 days.

(21) Appl. No.: 11/122,100

(22) Filed: May 5, 2005

(65) Prior Publication Data

US 2005/0253517 A1 Nov. 17, 2005

(30) Foreign Application Priority Data

May 13, 2004 (KR) ..... 10-2004-0033805

(51) Int. Cl.
*H01J 17/49* (2006.01)

(52) U.S. Cl. ..... 313/586; 313/582; 313/583; 313/584; 313/585

(58) Field of Classification Search ..... 345/37, 345/41, 60, 71; 313/582–587, 292; 315/169.1, 315/169.4
See application file for complete search history.

(56) References Cited

U.S. PATENT DOCUMENTS 5,371,437 A * 12/1994 Amano ..... 315/169.1
5,744,909 A * 4/1998 Amano ..... 313/585
6,469,451 B2 * 10/2002 Mori ..... 315/169.4
6,873,105 B2 * 3/2005 Akiba ..... 313/586
6,903,711 B2 * 6/2005 Akiba ..... 345/67
7,098,595 B2 * 8/2006 Jang et al. ..... 313/587
2004/0032215 A1 * 2/2004 Nishimura et al. ..... 315/169.3
2005/0093444 A1 * 5/2005 Woo et al. ..... 313/582
2005/0225242 A1 * 10/2005 Woo et al. ..... 313/582
2005/0225244 A1 * 10/2005 Ahn et al. ..... 313/582
2005/0242722 A1 * 11/2005 Yoo et al. ..... 313/582
2006/0113884 A1 * 6/2006 Chueh et al. ..... 313/461

FOREIGN PATENT DOCUMENTS

JP 10302646 11/1998
JP 2000133144 A * 5/2000
JP 2002063842 2/2002
JP 2004031163 1/2004

* cited by examiner

*Primary Examiner*—Sikha Roy
*Assistant Examiner*—Jose M Diaz
(74) *Attorney, Agent, or Firm*—H.C. Park & Associates, PLC

(57) ABSTRACT

A plasma display panel including a first substrate and a second substrate opposing each other, partition walls disposed between the first substrate and the second substrate and defining a plurality of discharge cells, pairs of first electrodes disposed at first side surfaces of the partition walls and opposing each other in the respective discharge cells, pairs of second electrodes disposed at second side surfaces of the partition walls and opposing each other in the respective discharge cells and extending in a direction intersecting the first electrodes, and a dielectric layer formed at the first side surfaces and the second side surfaces of the partition walls covering the first and the second electrodes. A convex portion of the dielectric layer covers at least one electrode.

34 Claims, 8 Drawing Sheets

PLASMA DISPLAY PANEL COMPRISING A DIELECTRIC LAYER WITH A CONVEX PORTION

CROSS REFERENCE TO RELATED APPLICATION

This application claims priority to and the benefit of Korean Patent Application No. 10-2004-0033805, filed on May 13, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP having a decreased discharge voltage and improved discharge efficiency.

2. Discussion of the Background

Display apparatuses such as PDPs are widely used. PDPs may have excellent characteristics such as high image quality and a wide viewing angle. Further, they may be made very thin and light weight, and they can be easily manufactured to have large-sized screens.

Generally, PDPs may be classified as direct current (DC) PDPs, alternating current (AC) PDPs, and hybrid PDPs depending on applied discharge voltage characteristics and discharge cell structure. Further, they may also be classified as opposing discharge PDPs and surface-discharge PDPs depending on discharge electrode structures. An AC PDP having a three-electrode surface-discharge structure is often utilized.

FIG. 1 shows a conventional AC three-electrode surface-discharge PDP 100.

Referring to FIG. 1, the PDP 100 may include an upper panel 110 and a lower panel 120. The upper panel 110 may have a front substrate 111, common electrodes 112, which are formed on a lower surface of the front substrate 111, scanning electrodes 113, which form discharge gaps in cooperation with the common electrodes 112, a first dielectric layer 114 covering the common electrodes 112 and the scanning electrodes 113, and a protective layer 115 covering the first dielectric layer 114. The lower panel 120 may have a rear substrate 121, address electrodes 122, which are disposed on the rear substrate 121 extending in a direction intersecting the common electrodes 112 and the scanning electrodes 113, a second dielectric layer 123 covering the address electrodes 122, partition walls 128, which are formed on an upper surface of the second dielectric layer 123 and define discharge cells 125, fluorescent layers 126 formed inside the discharge cells 125, and a discharge gas (not shown) filled within the discharge cells 125.

In such a conventional PDP, the scanning and common electrodes 113, 112, the dielectric layer 114, and the protective layer 115 may absorb approximately 40% of the otherwise visible rays emitted from the fluorescent layers 126, thereby decreasing light emission efficiency.

Further, charged particles in the discharge cells 125 may diffuse toward the electrode as well as the partition walls 128 due to an electric field. Charged particles that collide with the partition walls 128 may not participate in a gas discharge. Consequently, the PDP's discharge efficiency may decrease.

SUMMARY OF THE INVENTION

The present invention provides a PDP having a decreased discharge voltage and improved discharge efficiency.

Additional features of the invention will be set forth in the description which follows, and in part will be apparent from the description, or may be learned by practice of the invention.

The present invention discloses a plasma display panel including a first substrate and a second substrate opposing each other, partition walls disposed between the first substrate and the second substrate and defining a plurality of discharge cells, pairs of first electrodes at first side surfaces of the partition walls and opposing each other in the respective discharge cells, pairs of second electrodes disposed at second side surfaces of the partition walls and opposing each other in the respective discharge cells and extending in a direction intersecting the first electrodes, and a dielectric layer formed at the first side surfaces and the second side surfaces of the partition walls and covering the first electrodes and the second electrodes. A convex portion of the dielectric layer covers at least one electrode.

The present invention also discloses a plasma display panel including a first substrate and a second substrate opposing each other, partition walls between the first substrate and the second substrate and defining a plurality of discharge cells, a pair of first electrodes disposed at first side surfaces of the partition walls and opposing each other in the respective discharge cells, a pair of second electrodes disposed at second side surfaces of the partition walls and opposing each other in the respective discharge cells and extending in a direction intersecting the first electrodes, and a dielectric layer formed on the first side surfaces and the second side surfaces of the partition walls and covering the first electrodes and the second electrodes. The dielectric layer is thickest at a portion covering the first electrodes and the second electrodes.

The present invention also discloses a PDP including first substrate and a second substrate opposing each other, partition walls between the first substrate and the second substrate and defining a plurality of discharge cells, first electrodes extending in a first direction, and second electrodes extending in a second direction that is substantially orthogonal to the first direction. A discharge cell includes a pair of first electrodes and a pair of second electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
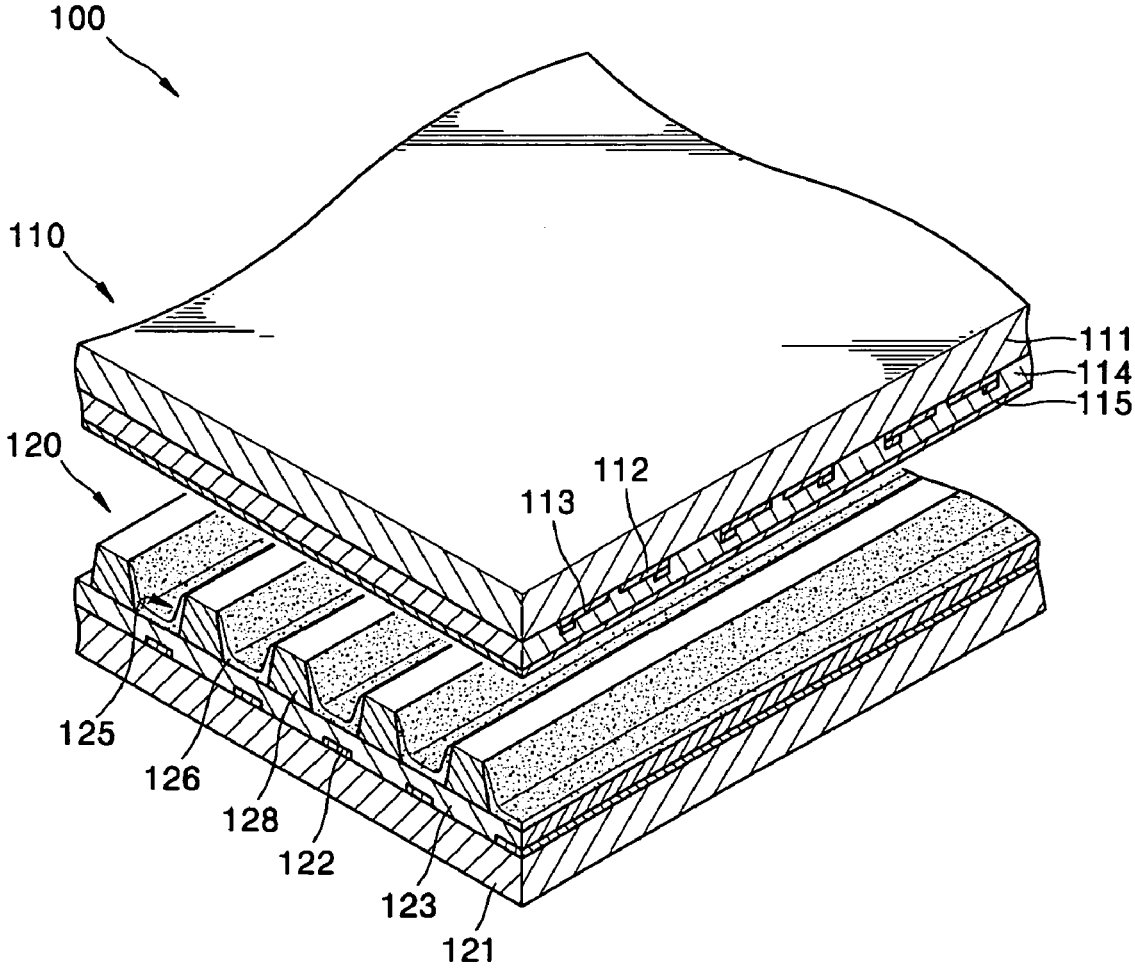
FIG. 1 (PRIOR ART)
FIG. 1 is an exploded perspective view showing a conventional PDP.

Hereinafter, a PDP 200 according to an exemplary embodiment of the present invention will be described with reference to FIG. 2, FIG. 3, FIG. 4, FIG. 5, FIG. 6, FIG. 7, FIG. 8 and FIG. 9.

The PDP 200 may include a first substrate 201 and a second substrate 202 opposing each other, and partition walls 205, which define a plurality of discharge cells 220, may be disposed between the first substrate 201 and the second substrate 202. Pairs of first electrodes 206 may be disposed at opposing side surfaces of the partition walls 205 in each discharge cell 220, and pairs of second electrodes 207 may be disposed at other opposing side surfaces of the partition walls 205 in each discharge cell 220. The second electrodes 207 may extend in a direction intersecting the first electrodes 206. Dielectric layers 208, which may be formed at side surfaces of the partition walls 205 to cover the first electrode 206 and the second electrode 207, may have a convex portion covering at least one of the electrodes. Fluorescent layers 210 may be disposed inside the discharge cells 220.

In the present embodiment, since visible rays generated at the discharge cells 220 emit through the first substrate 201, the first substrate 201 may be made of a material such as, for example, glass, which has excellent light-transmittance. Unlike the conventional PDP of FIG. 1, the first substrate 201 does not have electrodes 112 and 113. Hence, transmittance of visible rays toward the front side of the PDP 200 may be significantly improved. Consequently, in order to display images with the same brightness as a conventional level, the electrodes 206 and 207 can be driven at a relatively lower voltage, thereby improving light emission efficiency.

The second substrate 202 may also be made of a material such as glass.

The partition walls 205, which may be formed between the first substrate 201 and the second substrate 202, define the discharge cells 220 in which a plasma discharge occurs, in cooperation with the substrates 201 and 202. The partition walls 205 may include first partition walls 205*a*, which extend in a direction parallel to each other, and second partition walls 205*b*, which extend parallel to each other in a direction intersecting the first partition walls 205*a*. The first partition walls 205*a* and the second partition walls 205*b* may be integrally formed. The partition walls 205 define the plurality of discharge cells 220 in a matrix shape so that each cell has an independent discharge space.

Figure 2:
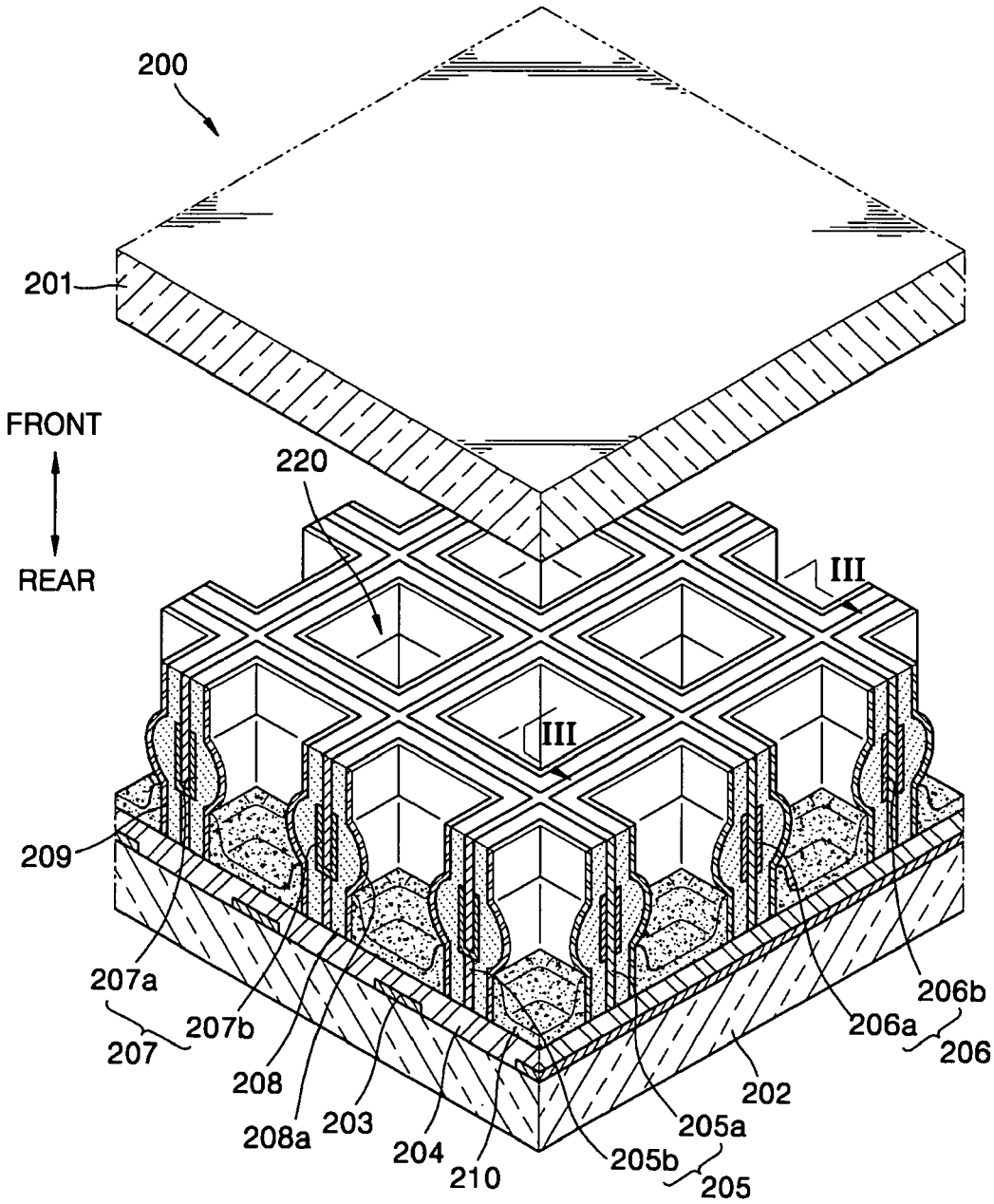
FIG. 2 is an exploded perspective view showing a PDP according to an exemplary embodiment of the present invention.

FIG. 2 shows the partition walls 205 in a matrix shape defining the discharge cells 220 having a rectangular tetragonal cross-section, but the present invention is not limited thereto. Rather, the partition walls 205 may have various shapes forming the discharge cells 220.

A pair of the first and the second electrodes 206 and 207 may be disposed on is opposing side surfaces of the partition walls 205 in each discharge cell 220. Specifically, the first electrodes 206*a* and 206*b* may be disposed on both side surfaces of the first partition walls 205*a*, and the first electrodes 206*a* and 206*b* may oppose each other in each discharge cell 220. Further, the second electrodes 207*a* and 207*b* may be disposed on both side surfaces of the second partition walls 205*b*, and the second electrodes 207*a* and 207*b* may oppose each other in each discharge cell 220.

Figure 3:
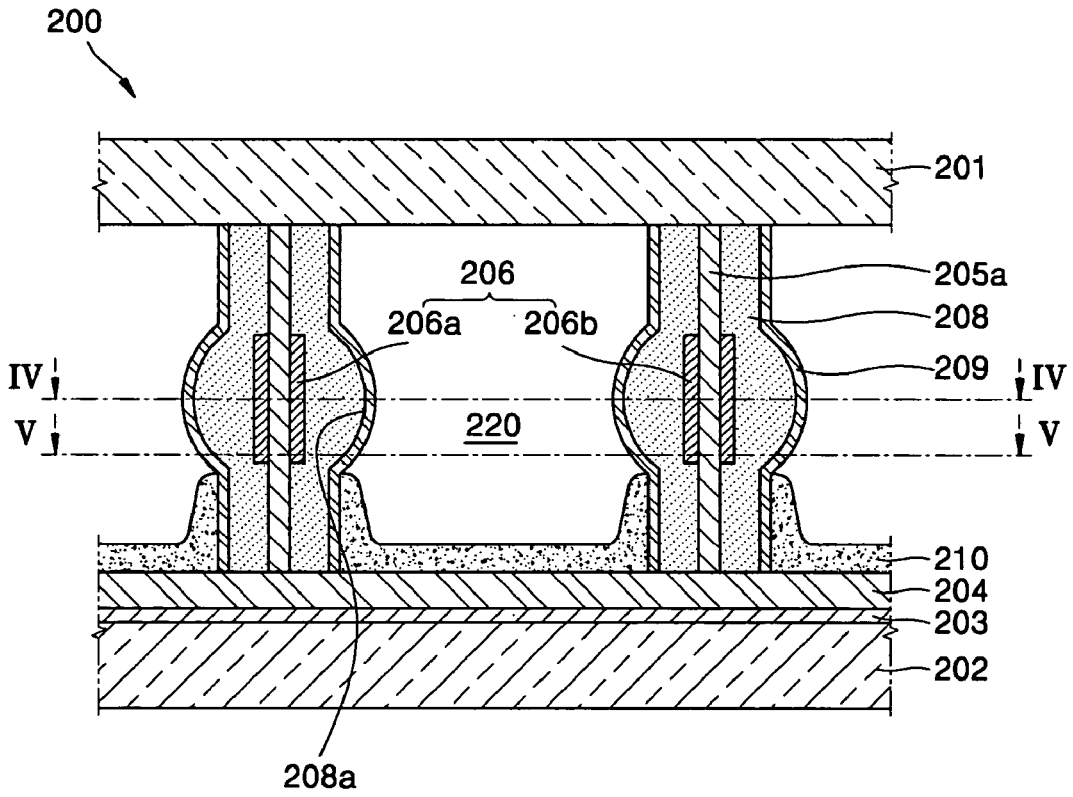
FIG. 3 is a sectional view taken along line III-III of FIG. 2.
Figure 4:
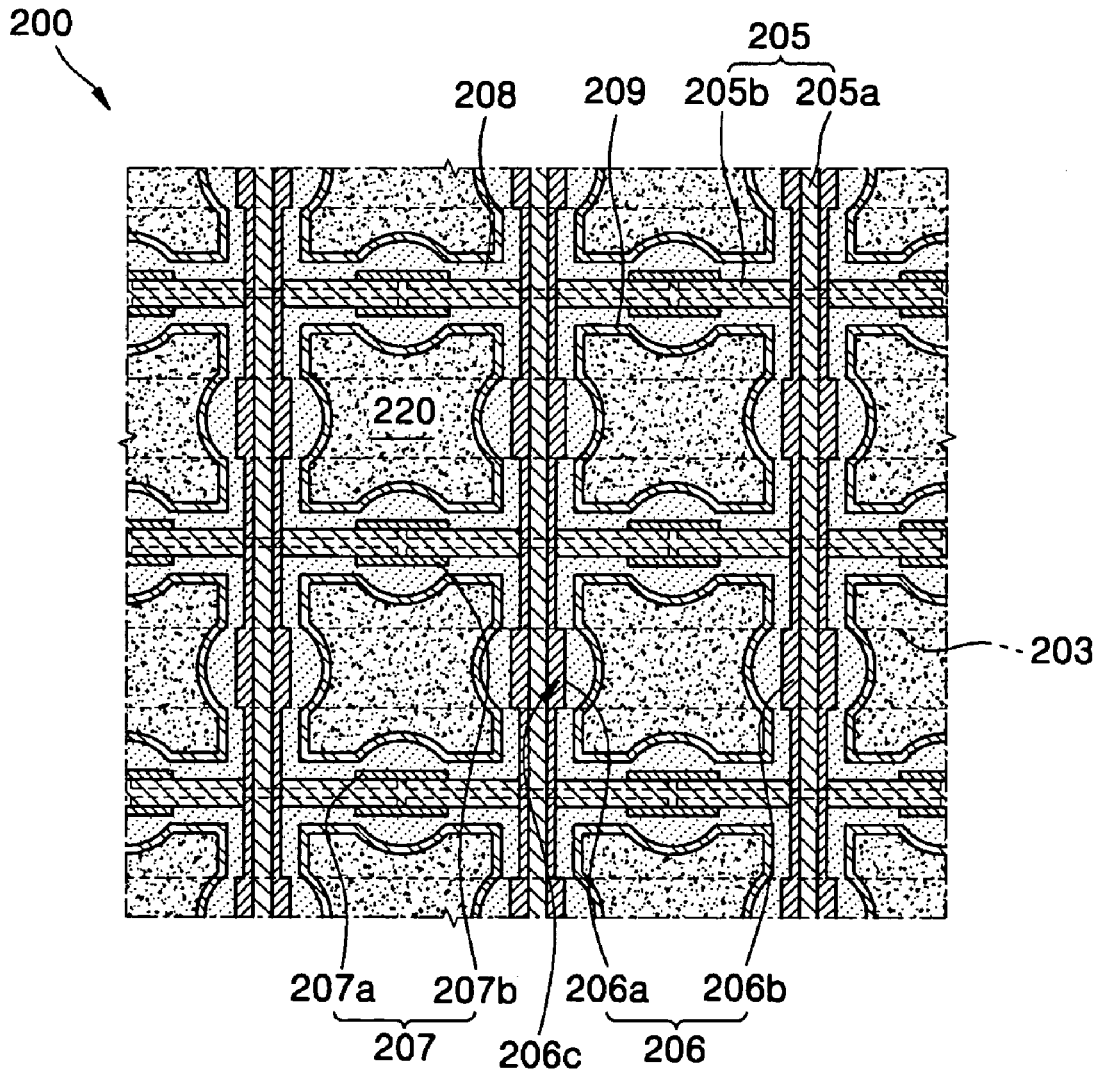
FIG. 4 is a sectional view taken along line IV-IV of FIG. 3, which also shows adjacent discharge cells.
Figure 5:
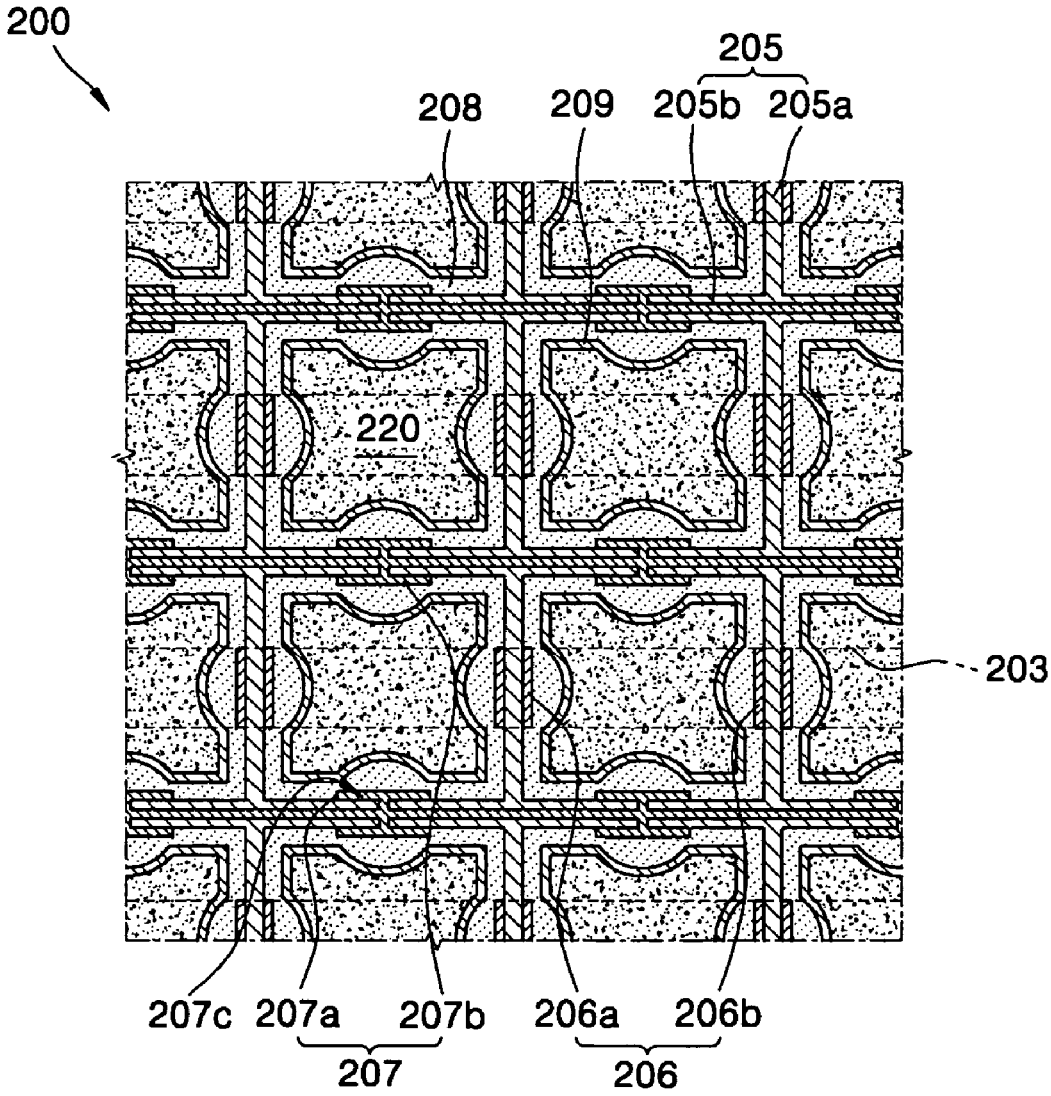
FIG. 5 is a sectional view taken along line V-V of FIG. 3, which also shows adjacent discharge cells.

As shown in FIG. 4 and FIG. 5, which are sectional views taken along lines IV-IV and V-V of FIG. 3, respectively, the first electrodes 206 and the second electrodes 207 are spaced apart from each other at points where they cross. For example, portions of the first electrodes 206 interconnecting expanded portions 206*c* of the first electrodes 206 may be formed above (i.e. nearer to the first substrate 201) portions of the second electrodes 207 interconnecting expanded portions 207*c* of the second electrodes 207. However, the positions of the first and the second electrodes 206 and 207 can be exchanged with each other.

Figure 6:
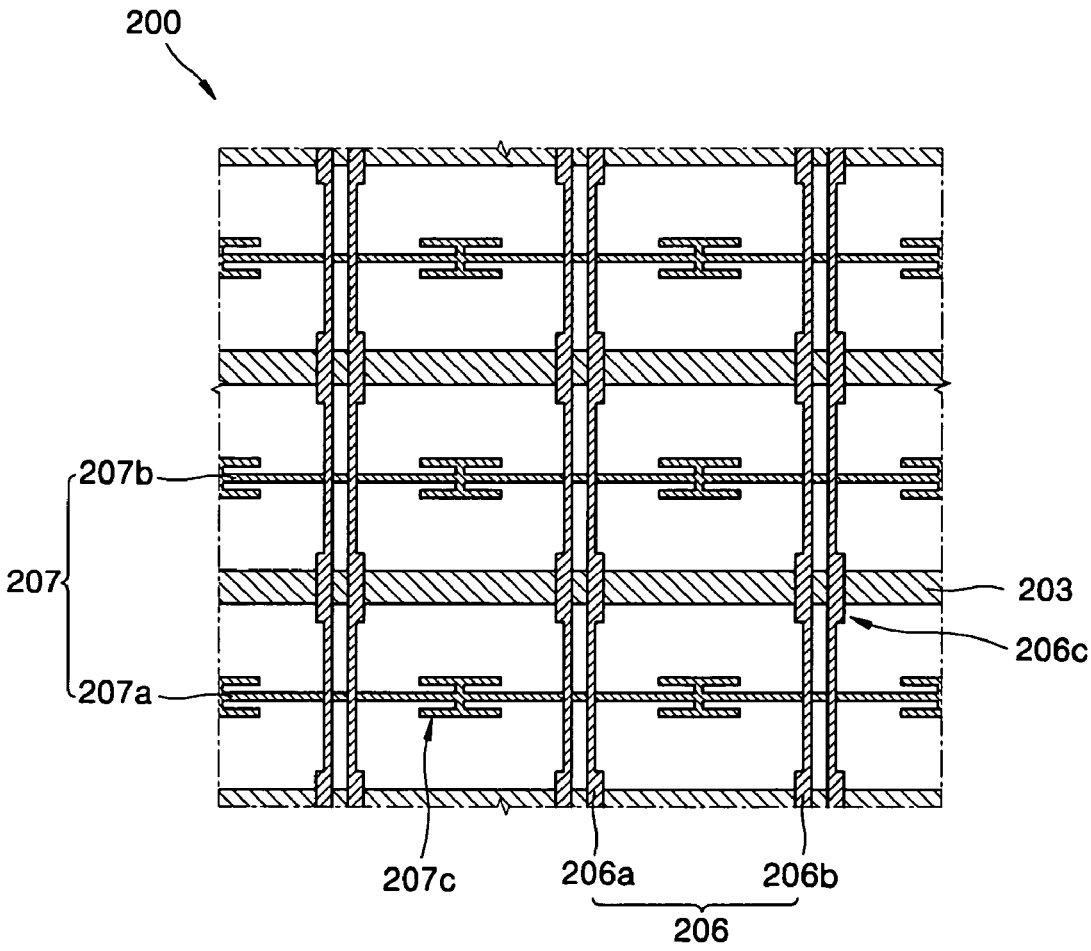
FIG. 6 is a schematic diagram showing an electrode arrangement according to an exemplary embodiment of the present invention.

FIG. 6 schematically shows a plan view of an arrangement of the first and second electrodes 206 and 207. Here, intersections of the electrodes 206 and 207 are vertically spaced from each other.

The first electrodes 206 extend along side surfaces of the first partition walls 205*a*, and the second electrodes 207 extend along the second partition walls 205*b* in a direction intersecting the first electrodes 206. The expanded portions 206*c* and 207*c* are formed at portions of the electrodes 206 and 207, respectively, which correspond to the insides of the discharge cells 220.

Due to the expanded-portions 206*c* and 267*c*, it may be possible to generate wall charges in a wide area inside the discharge cells 220 and to efficiently generate a discharge in the discharge space of the discharge cells 220.

The first electrodes 206 and the second electrodes 207 may be made of a conductive metal such as, for example, aluminium, copper, etc.

The PDP 200 may further include third electrodes 203. If included, the third electrodes 203 may serve as address electrodes. In this case, the first electrodes 206 may serve as scanning electrodes, and the second electrodes 207 may serve as common electrodes.

Since the second electrodes 207 may serve as common electrodes, the second electrodes 207 in adjacent discharge cells 220 may be connected to each other through the second partition walls 205*b*. Therefore, a common sustain voltage may be applied to the second electrodes 207, which generate a sustain discharge in cooperation with the first electrodes 206.

If the third electrodes 203 are not included, the first electrodes 206 may serve as the scanning and sustain electrodes, and the second electrodes 207 may serve as the address and sustain electrodes.

Dielectric layers 208 may be formed on the partition walls 205 to cover the first and second electrodes 206 and 207. Specifically, the dielectric layers 208 may be coated on the side surfaces of the first partition walls 205*a* to cover the first electrodes 206. Further, the dielectric layers 208 may be coated on the side surfaces of the second partition walls 205*b* to cover the second electrodes 207. The dielectric layers 208 may be locally formed on portions of the partition walls 205 where the first and the second electrodes 206 and 207 are formed, or, as FIG. 2 shows, they may be formed to cover the entire partition wall 205 in each discharge cell.

Further, portions of the dielectric layers 208 covering the first and second electrodes 206 and 207 may be formed as convex portions 208*a*. Specifically, the convex portions 208*a* of the dielectric layers 208 may protrude toward the inside of each discharge cell 220. Therefore, the dielectric layer 208 may be thinner at portions not covering the first and the second electrodes 206 and 207. The dielectric layers 208 having the convex portions 208*a* may have a symmetric shape for a uniform discharge.

The dielectric layers 208 prevent the first electrodes 206 and the second electrodes 207 from being electrically connected to each other, they protect the electrodes 206 and 207 from damage due to collision with charged particles, and they store wall charges by inducing the charged particles. The dielectric layers 208 may be made of a dielectric substance such as, for example, PbO, $B_2O_3$, $SiO_2$, etc.

Protective layers 209 may cover the dielectric layers 208. The protective layers 209 may be made of, for example, magnesium oxide (MgO). The protective layers 209 protect the dielectric layers 208 from damage due to collision with charged particles, and they emit secondary electrons during discharging.

The third electrodes 203 may be formed between the second substrate 202 and the fluorescent layers 210, and they may extend in a direction intersecting the discharge cells 220. Specifically, the third electrodes 203 may be disposed between the second partition walls 205*b*. Hence, as FIG. 6 shows, in the present embodiment, the third electrodes 203 may extend parallel with the second electrodes 207.

Alternatively, the third electrodes 203 may be formed extending in a direction intersecting the second electrodes 207. In other words, the third electrodes 203 may be formed parallel with the first electrodes 206. In this case, the third electrodes 203 would be disposed between the first partition walls 205*a*.

A lower dielectric layer 204 may prevent cations or electrons from colliding with and damaging the third electrodes 203, and it can induce electric charges. The lower dielectric layer 204 may be made of, for example, PbO, $B_2O_3$, $SiO_2$, etc. In the present embodiment, a voltage may be applied to the third electrodes 203 to implement a function of the address electrodes.

Fluorescent layers 210 may be formed on side surfaces of the partition walls 205, which may be covered by the dielectric layers 208 and the protective layers 209, and on the lower dielectric layers 204. The fluorescent layers 210 receive ultraviolet rays and emit visible rays. The fluorescent layers formed in sub-pixels emitting red light may include a fluorescent substance such as, for example, $Y(V, P)O_4$:Eu, etc., the fluorescent layers formed in sub-pixels emitting green light may include a fluorescent substance such as, for example, $Zn_2SiO_4$:Mn, $YBO_3$:Tb, etc., and the fluorescent layers formed in sub-pixels emitting blue light may include a fluorescent substance such as, for example, BAM:Eu, etc.

A discharge gas comprising Ne, Xe, etc. may be filled and sealed within the discharge cells 220. In the present invention, since the discharge area can be increased and the discharge space can be enlarged, an amount of generated plasma may increase and low-voltage driving may be possible. Therefore, even if the discharge gas comprises highly-concentrated Xe gas, low-voltage driving may be possible, which may significantly increase light emission efficiency. Hence, the present invention may overcome the difficulty in performing low-voltage driving when using highly-concentrated Xe gas as the PDP's discharge gas.

In the PDP 200 having the above-described construction according to exemplary embodiments of the present invention, applying an address voltage between a third electrode 203 and a first electrode 206 may generate an address discharge, thereby selecting a discharge cell to be sustain discharged.

Next, applying a sustain discharge voltage between the first electrode 206 and the second electrode 207 of the selected discharge cell 220 generates a sustain discharge between the first electrode 206 and the second electrode 207. The sustain discharge excites the discharge gas, which emits ultraviolet rays as its energy level decreases. The ultraviolet rays excite the fluorescent layers 210, which emit visible light while the layers' energy level decreases, thereby forming an image.

The characteristics of the sustain discharges occurring in the discharge cells 220 will now be described.

Each discharge cell 220 comprises a pair of first electrodes 206*a* and 206*b* and a pair of second electrodes 207*a* and 207*b*. A voltage having the same wave form may be applied to the first electrodes 206*a* and 206*b*. Further, a voltage having the same wave form may be applied to the second electrodes 207*a* and 207*b*.

Figure 7:
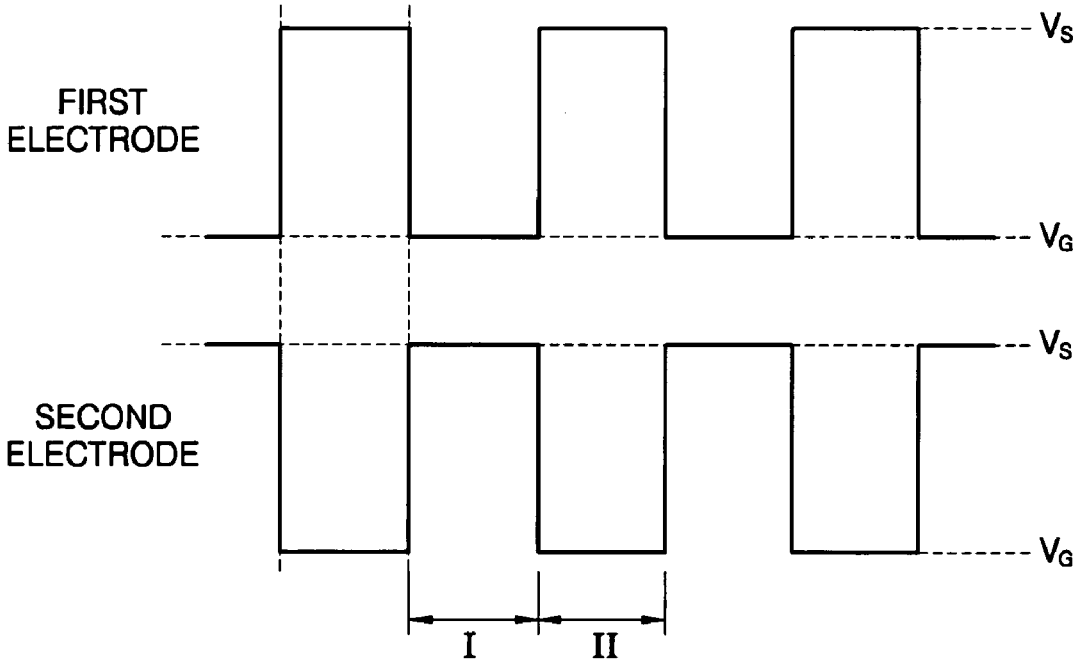
FIG. 7 is a diagram showing a voltage that may be applied to the PDP of FIG. 2 during a sustain discharge.
Figure 8:
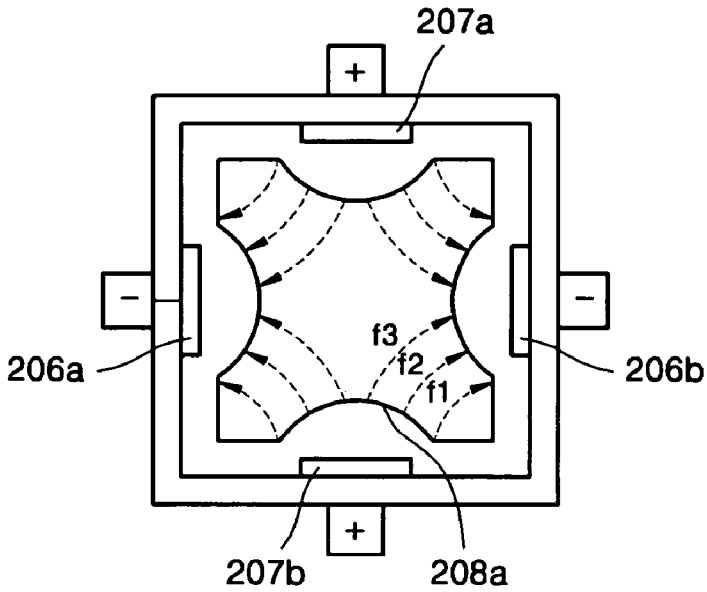
FIG. 8 is a schematic diagram showing discharge characteristics in section 'I' of FIG. 7.
Figure 9:
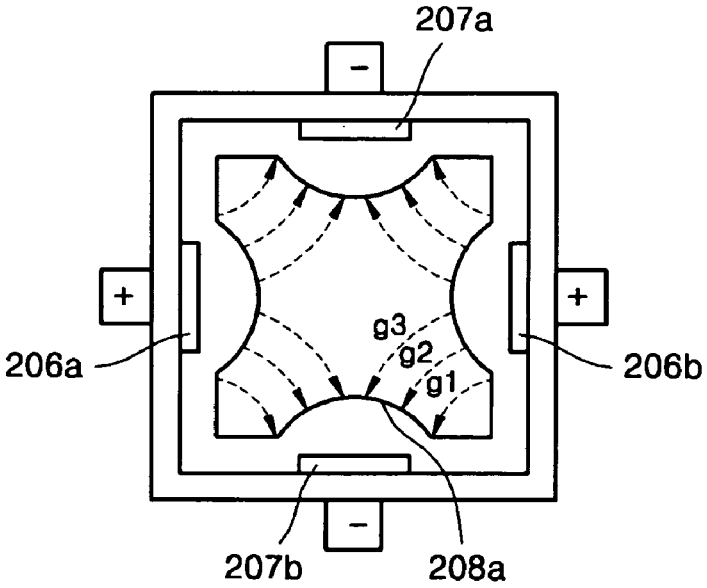
FIG. 9 is a schematic diagram showing discharge characteristics in section 'II' of FIG. 7.

FIG. 7 shows discharge sustain pulses, which may be applied to the electrodes 206*a*, 206*b*, 207*a*, and 207*b* of the PDP according to an exemplary embodiment of the present invention. FIG. 8 and FIG. 9 schematically show discharge characteristics of a sustain discharge occurring during sections "I" and "II" of FIG. 7, respectively.

Referring to FIG. 7, a sustain voltage $V_S$ may be applied to the second electrodes 207*a* and 207*b* in section "I" and a ground voltage $V_G$, which is a voltage that is less than the sustain voltage $V_S$, may be applied to the first electrodes 206*a* and 206*b*. As FIG. 8 shows, the second electrodes 207*a* and 207*b*, whose voltage is relatively high, become positive electrodes, the first electrodes 206*a* and 206*b*, whose voltage is relatively low, become negative electrodes, and an electric field is generated within the discharge cell. The discharge starts on a first path f1 in the corner where the distance between the first and second electrodes is shortest, and it sequentially spreads along a second path f2 and a third path f3, where the distance between the electrodes is relatively long.

In the PDP 200 according to exemplary embodiments of the present invention, since each dielectric layer 208 has a convex cross-section, dielectric constants of the second and the third paths f2 and f3 become relatively higher, as compared to a structure in which a dielectric layer has a flat cross-section. This is because the discharge path traversing the discharge gas having a low dielectric constant decreases due to the convex portion 208*a* of the dielectric layer 208 having a high dielectric constant. Consequently, the discharge may occur at a relatively low discharge voltage.

Applying the voltages in section "II" of FIG. 7 to the first and the second electrodes 206*a*, 206*b*, 207*a*, and 207*b* switches the relative electric potentials of the electrodes. Thus, as FIG. 9 shows, the discharge occurs along a first path g1, a second path g2, and a third path g3 in a similar manner as the discharge in section "I". Further, as described above, the required discharge voltage may decrease due to the convex portions 208*a* of the dielectric layers 208, and stable discharge may be made possible.

In the PDP 200 according to the present invention, since the electrodes 206 and 207 are disposed at the side surfaces of the partition walls 205 and the discharge occurs between the electrodes 206 and 207, the number of charged particles not participating in the discharge decreases.

Specifically, according to the present invention, a sustain discharge starts in four corners of a discharge cell 220 and gradually spreads toward the discharge cell's center. Therefore, the volume of the space in which the sustain discharge occurs may increase. Further, the space charges in the discharge cells 220, which may not be used in the conventional art, may contribute to light emission. Hence, the PDP's discharge efficiency may increase.

According to the present invention, since the dielectric layers covering the first and the second electrodes have a convex cross section, a dielectric constant between the first and the second electrodes, where a discharge occurs by means of a dielectric substance having a relatively high dielectric constant, can increase. Therefore, a relatively lower discharge voltage may generate a discharge, and the discharge can stably occur.

In the PDP according to the present invention, since the first substrate does not have electrodes, a transmittance of the PDP's visible rays may significantly increase.

In the PDP according to the present invention, since fewer particles may be lost due to collision against the partition walls, discharge efficiency may improve.

In the PDP according to the present invention, since a discharge may occur in all side surfaces forming a discharge space, the discharge surface is significantly widened. Specifically, since the discharge first occurs at four corners of each discharge cell and then diffuses into the cell's center portion, a discharge area significantly increases, as compared to a conventional PDP, whereby more space of the discharge cell may be efficiently utilized. As a result, the discharge can occur at a lower voltage, thereby increasing light emission efficiency.

The PDP according to the present invention has a structure in which low-voltage driving may be possible. Therefore, even if highly-concentrated Xe gas is used as the discharge gas, low-voltage driving may be possible, thereby improving light emission efficiency.

The same elements are denoted by the same reference numerals in the above-described figures.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate and a second substrate opposing each other;

partition walls between the first substrate and the second substrate and defining a plurality of discharge cells;

pairs of first electrodes at first side surfaces of the partition walls, the first electrodes opposing each other in a discharge cell;

pairs of second electrodes at second side surfaces of the partition walls, the second electrodes opposing each other in the discharge cell and extending in a direction intersecting the first electrodes; and a dielectric layer formed on the first side surfaces and the second side surfaces of the partition walls and covering the first electrodes and the second electrodes, wherein a convex portion of the dielectric layer covers at least one electrode.

2. The PDP of claim 1, wherein the dielectric layer, which is formed in the discharge cells, has a symmetric shape.

3. The PDP of claim 1, wherein the first electrodes extend in a direction along the first side surfaces of the partition walls.

4. The PDP of claim 1, wherein the second electrodes extend in a direction along the second side surfaces of the partition walls.

5. The PDP of claim 1, further comprising third electrodes extending in a direction intersecting the discharge cells.

6. The PDP of claim 5, further comprising a fluorescent layer formed in the discharge cells, wherein the third electrodes are disposed between the fluorescent layer and the second substrate.

7. The PDP of claim 5, wherein the third electrodes are arranged substantially parallel with the first electrodes or the second electrodes.

8. The PDP of claim 5, further comprising a lower dielectric layer covering the third electrodes.

9. The PDP of claim 1, further comprising a protective layer covering the dielectric layer.

10. The PDP of claim 1, wherein the partition walls are formed in a matrix shape.

11. The PDP of claim 1, wherein second electrodes in discharge cells, which are adjacent to each other in a direction substantially perpendicular to the direction the second electrodes extend, are connected to each other.

12. The PDP of claim 1, wherein the first electrodes and the second electrodes comprise expanded-portions.

13. The PDP of claim 1, wherein the first electrodes and the second electrodes are spaced apart from each other.

14. A plasma display panel (PDP), comprising:

a first substrate and a second substrate opposing each other;

partition walls between the first substrate and the second substrate and defining a plurality of discharge cells;

pairs of first electrodes disposed at first side surfaces of the partition walls, the first electrodes opposing each other in a discharge cell;

pairs of second electrodes at second side surfaces of the partition walls, the second electrodes opposing each other in the discharge cell and extending in a direction intersecting the first electrodes; and a dielectric layer formed on the first side surfaces and the second side surfaces of the partition walls and covering the first electrodes and the second electrodes, wherein the dielectric layer is thickest at a portion covering the first electrodes and the second electrodes.

15. The PDP of claim 14, wherein the dielectric layer in each discharge cell has a symmetric shape.

16. The PDP of claim 14, wherein the first electrodes extend in a direction along the first side surfaces of the partition walls.

17. The PDP of claim 14, wherein the second electrodes extend in a direction along the second side surfaces of the partition walls.

18. The PDP of claim 14, further comprising third electrodes extending in a direction intersecting the discharge cells.

19. The PDP of claim 18, further comprising a fluorescent layer formed in the discharge cells, wherein the third electrodes are disposed between the fluorescent layer and the second substrate.

20. The PDP of claim 18, wherein the third electrodes are arranged substantially parallel with the first electrodes or the second electrodes.

21. The PDP of claim 18, further comprising a lower dielectric layer covering the third electrodes.

22. The PDP of claim 14, further comprising a protective layer covering the dielectric layer.

23. The PDP of claim 14, wherein the partition walls are formed in a matrix shape.

24. The PDP of claim 14, wherein second electrodes in discharge cells, which are adjacent to each other in a direction substantially perpendicular to the direction the second electrodes extend, are connected to each other.

25. The PDP of claim 14, wherein the first electrodes and the second electrodes comprise expanded-portions.

26. The PDP of claim 14, wherein the first electrodes and the second electrodes are spaced apart from each other.

27. A plasma display panel (PDP), comprising:

a first substrate and a second substrate opposing each other;

partition walls between the first substrate and the second substrate and defining a plurality of discharge cells;

first electrodes extending in a first direction; and second electrodes extending in a second direction that is substantially orthogonal to the first direction, wherein a discharge cell comprises a pair of first electrodes and a pair of second electrodes, the pair of first electrodes being scanning electrodes and wherein the partition walls comprise a first partition wall extending along the first direction and a second partition wall extending along the second direction, and the first electrodes extend along the first partition wall and the second electrodes extend along the second partition wall.

28. The PDP of claim 27, further comprising a dielectric layer formed on sides of the partition walls and covering the first electrodes and the second electrodes, wherein the dielectric layer has a convex portion that covers at least one electrode in the discharge cell.

29. The PDP of claim 28, wherein the dielectric layer, which is formed in the discharge cell, has a symmetric shape.

30. The PDP of claim 27, wherein a second electrode in a first discharge cell is connected to a second electrode in a second discharge cell, wherein the first discharge cell and the second discharge cell are adjacent to each other along the first direction.

31. The PDP of claim 30, wherein the second electrode in the first discharge cell is connected to the second electrode in the second discharge cell through the second partition wall.

32. The PDP of claim 27, wherein the first electrodes and the second electrodes comprise expanded portions.

33. The PDP of claim 27, further comprising third electrodes extending in the first direction or the second direction, wherein the third electrodes are formed in locations corresponding to centers of the discharge cells.

34. The PDP of claim 33, further comprising a fluorescent layer formed in the discharge cells, wherein the third electrodes are disposed between the fluorescent layer and the second substrate.

* * * * *